United States Patent [19]

Flakk

[11] Patent Number: 4,860,811

[45] Date of Patent: Aug. 29, 1989

[54] TURNABLE WINDOW ARRANGEMENT

[75] Inventor: Egil Flakk, Ålesund, Norway

[73] Assignee: A/S Spilka Inco Ltd., Alesund, Norway

[21] Appl. No.: 157,647

[22] Filed: Feb. 18, 1988

[51] Int. Cl.[4] ..... E06B 3/32

[52] U.S. Cl. ..... 160/92; 49/354

[58] Field of Search ..... 49/354, 356; 160/92; 292/262, 277, 278

[56] References Cited

U.S. PATENT DOCUMENTS

| | | | |
|---|---|---|---|
| 1,544,387 | 6/1925 | Fulton | 292/277 X |
| 1,829,343 | 10/1931 | Dodds et al. | 49/356 X |
| 2,620,214 | 12/1952 | Coccetti | 49/356 |
| 2,702,205 | 2/1955 | Germain | 292/278 X |
| 2,881,483 | 4/1959 | Ginther | 160/92 X |
| 3,747,272 | 7/1973 | Martin | 49/356 |
| 3,773,371 | 11/1973 | Carlsson | 292/278 X |

FOREIGN PATENT DOCUMENTS

| | | | |
|---|---|---|---|
| 87776 | 11/1959 | Denmark | 292/262 |
| 486977 | 6/1938 | Netherlands | 292/278 |

*Primary Examiner*—Ramon S. Britts
*Assistant Examiner*—David G. Kolman
*Attorney, Agent, or Firm*—Kenyon & Kenyon

[57] ABSTRACT

A turnable window arrangement has a window sash to be rotated about a horizontal axis through approximately 180° relative to a window frame. The window frame is provided with a separately removable air screening filter secured to the frame in a position inside the swinging path of said sash. A link arm mechanism is arranged to lock the sash in different positions between completely closed and opened venting positions.

9 Claims, 2 Drawing Sheets

TURNABLE WINDOW ARRANGEMENT

This invention relates to turnable window arrangements to be used together with air screen filters.

As is known air screen filters for turnable window arrangements are normally located at a position outside the window sash to allow the window to be opened and closed inside the air screen filter. However, this location of the air screen filter is unfavorable in many different aspects. First of all, the air screen filter may be subjected to unfavorable atmospheric conditions such as moisture, including rain, snow, ice, wind pressure in combination with moisture, combinations of wind and dust, and the like. In such cases with this location of the screen filter, the venting effect of the air screen filter may in a rather short application time be weakened or even destroyed. Thus, in order for the air screen filter to always serve as a screen for the window per se the screen has to be made of a material that has sufficient strength to stand against atmospheric interactions and being of sufficient quality to last over a specific period of time.

The location of the screen filter in relation to the window sash per se also complicates the operation of the window, especially swing windows and turnable windows, as these have to be swung a certain distance into the adjacent room.

Accordingly, it is an object of the invention to eliminate the above-mentioned problems by locating the air screen filter inside the window sash and thereby allow the air screen filter to be shielded from atmospheric interactions normally and at least in closed window positions and preferably also in certain venting positions of the window.

It is another object of the invention to allow unrestricted opening and closing of the window outside the air screen filter without necessarily opening or removing the screen filter to gain access to the mechanism for opening and closing of the window.

It is another object of the invention to obtain a simple and easily operable mechanism for opening and closing a window with an air screen filter in a filtering position.

It is another object of the invention to allow the outwards facing side of the window sash to be tilted an angle of approximately 90° to an inwards facing cleaning position, when such cleaning operations are required.

Accordingly, the present invention resides in a turnable window arrangement of the kind in which a window sash is capable of being rotated about a horizontal axis through approximately 180° relative to a window frame and is provided with a separately removable air screening filter secured to the frame in a position inside the swinging path of the sash. In addition, a link arm mechanism is arranged to lock the sash in different positions between completely closed and opened venting positions. This link arm mechanism comprises a socket member connected to the sash and a link arm pivotally mounted at the outer end of a support arm protruding from the socket member, to allow pivoting of the link arm about a first axis extending laterally of the support arm. The support arm is arranged to penetrate through a guide opening in a lock member secured to the frame in a position circumferentially outside the screen filter to allow unprevented movement of the link arm at an inwards facing side of the frame. The link arm and support arm are pivotable in the socket member about a second axis extending axially of the support arm to allow pivoting of the link arm from a locking position to an unlocked position, and vice versa, at the inwards facing side of the frame and to allow a minor pivoting between the support arm and the link arm in different venting positions of the window. The link arm is provided with a number of arresting means extending laterally of the link arm for cooperation with an adjustable locking pin in the locking member.

The invention makes possible a solution wherein the air screen filter under actual conditions provides an efficient screening effect upon opening of the window sash to a venting position. This efficiency is caused by the effective shielding effect provided by the window sash in its closed or even by the window sash in partly opened positions, i.e. in its different venting positions.

In addition, the present invention allows in a simple and uncomplicated manner a combination of the regulating mechanism for opening and closing of the window sash with a locking mechanism for efficient locking of the window sash in its closed position.

In order that the invention can be more clearly understood, a conveniant embodiment thereof will now be described, by way of example, with reference to the accompanying drawings in which.

Figure 1:
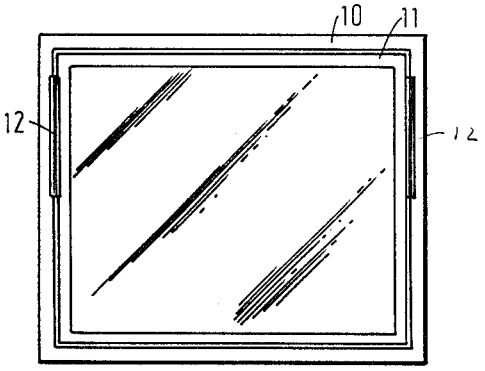
FIG. 1 is a front view of a turnable window as shown in closed position.
Figure 2:
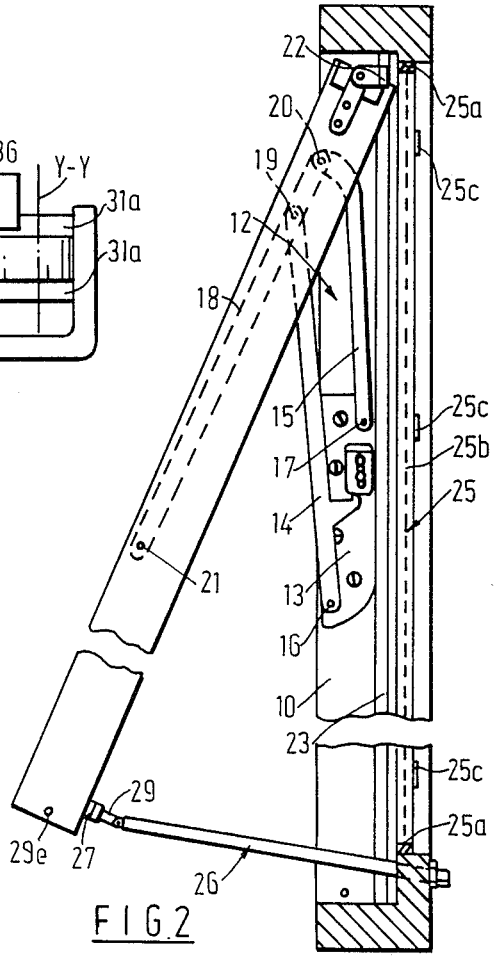
FIG. 2 is a section taken on line 2—2 of FIG. 1, with the window sash tilted in a venting position.

Referring to FIGS. 1 and 2, there is shown a turnable window comprising a window frame 10 and a window sash 11, both made of wood in the usual manner. However, in practice the frame and the sash may alternatively be made of other materials such as aluminum profiles or aluminum profiles covered with wood panels, etc.

There is illustrated in FIG. 1 a pair of support arm mechanisms 12, one at either side of the window, for support of the window sash in the window frame. Each of the mechanisms 12 comprises a socket member 13 secured to the window frame 10, a first lower pivot arm 14 and a second upper pivot arm 15 which are linked to the socket member 13 via respective link pins 16 and 17 together with a third pivot arm 18 which is linked to the outer ends of the pivot arms 14,15 via respective link pins 19 and 20. The pivot arm 14 and the pivot arm 18 are thus pivotally mounted about a common pivot axis defined by the pin 19. The pivot arm 18 is linked at the opposite end around a link pin 21 to the mid-portion of the window sash 11. At 22, there is shown one of two guide shoes which are pivotally mounted on opposite sides of the window sash at the normally upper edge of the window frame. The guide shoe 22 is slidably mounted in a groove 23 which runs over the height of the frame. On pivoting of the arms 14,15 about the link pins 16,17 of the socket member 13 and pivoting of the arm 18 correspondigly about the link pins 19,20 of the arms 14,15, the window sash can be swung in a swing path in a conventionally known manner about 180°, while the guide shoes 22 are displaced from the upper to the lower end of the groove 23. This swing movement can be controlled by exerting a pushing force against lower and upper edge portions of the window sash respectively.

In FIG. 2 is illustrated a screening filter 25 secured to the window frame. The screening filter comprises a rigid circumferential filter frame 25*a* supporting a wire netting, textile cloth 25*b* or similar filter material. By means of clips 25*c* or similar fastening means the screening filter may be secured to the window frame in an easily detachable manner.

In FIG. 2 the window sash 11 is being pushed to a partially opened venting position by means of a regulating link arm mechanism 26 with the screening filter 25 in its active filtering position. The link arm mechanism 26 is illustrated in details in FIGS. 3 to 7.

In FIGS. 3 to 7 the link arm mechanism is illustrated together with associated parts of the window frame 10 and the window sash 11, the latter parts being illustrated in FIGS. 3 to 7 in broken and in broken and dotted lines, respectively.

The link arm mechanism 26 comprises a socket member 27 being secured by means of screws 28 to the sash inner surface 11*a* (FIG. 7), that is normally facing inwards in an adjacent room. A support arm 29 protruding freely outwards from the socket member 27 is pivotable in said socket member about the central longitudinal axis x—x of the support arm 29. At the outer free end of the support arm 29 a pivot pin 30 is arranged with its pivot axis y—y crossing the longitudinal axis x—x with the pivot pin 30 supporting a fork-shaped inner end 31*a* of a regulating arm 31. The regulating arm 31 comprises a first, radially outer, pipe-shaped arm member 32 provided with the inner end 31*a* and a second, radially inner arm member 33 extending with one end thereof telescopically into the first arm member 32 and the opposite end thereof being provided with a regulating head 34. By means of a push button 35 at the head 34 a mechanism may be manually activated for release of a spring loaded stop means at the inner end of the inner arm member 33 from one of a number of arresting means being mutually spaced longitudinally of the inner surface of the outer arm member 32.

At the surface 10*a* of the window frame 10 facing the adjacent room, a locking means 36 is secured by means of lugs 37 and screws 38. The support arm 29 protrudes through a passage 39 in the frame 10 and via a guide opening 40 in the locking means 36 into the adjacent room. The cross-section of the passage 39 matches with the cross-section of a cylindrical sealing portion 29*b* of the support arm 29. In a closed window position an air seal is formed between a sealing portion 29*b* of the support arm 29 and the passage 39. The cross-section of the guide opening 40 is by preference also matching with the cross-section of the regulating arm 31 to form an air seal therebetween in different venting positions of the window sash.

A manually operated locking bar 41 is used as a security lock to prevent unintended activating by a child. The bar 41 is provided with a head portion 41*a* and is slidable from a retracted outer position in the locking member 36 to a pushed in position into an associated opening in the guide opening 40. In the closed position of the window as illustrated in FIGS. 3 to 6 an inner end 41*b* of the locking bar 41 is inserted in a bore 29*c* (FIG. 7) extending crosswise of the support arm 29 to form a lock therebetween. In different venting positions, e.g. in the position illustrated in FIGS. 2 and 7, the inner end 41*b* of the locking bar 41 is arranged to be inserted in corresponding bores 31*b* and 31*c* in the regulating arm 31 (and its head portion) to form corresponding locks therebetween.

A head member 29*d* of the support arm 29 protrudes from the rear side of the socket member 27 and into a spacing in the lower section of the window sash 11. The head member 29*d* is arranged to cooperate with an ordinary locking mechanism as indicated in broken and dotted lines in FIG. 3. By turning the support arm 29, say an angle of 90° about the axis x—x, the head member is arranged to push two cooperating locking pins (only one pin 29*e* is illustrated—see FIGS. 2 and 3) in opposite directions from a retracted inactive position in the window sash into corresponding locking grooves in the window frame, and in a reverse direction from the locking position to the retracted inactive position, respectively. In a position as illustrated in FIGS. 3 to 6 the window sash 11 is illustrated in its closed position with the head member 29*d* in a position corresponding to the active locking position of the locking pins.

Figure 3:
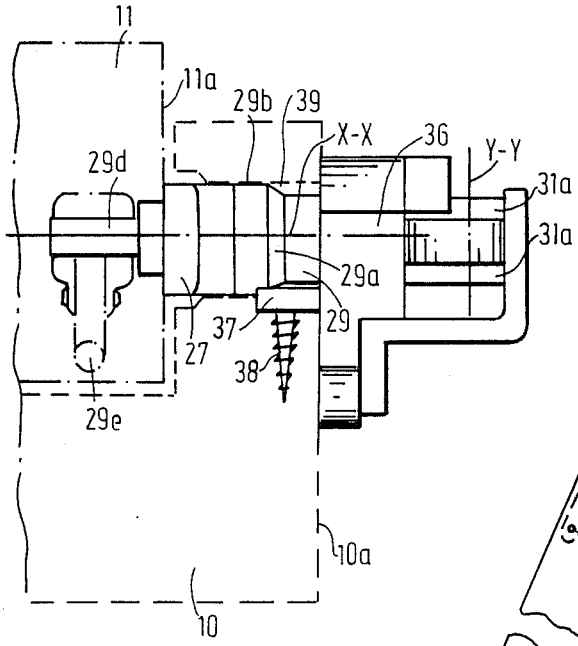
FIG. 3 is a side view of a link arm mechanism illustrated in a position corresponding to a closed window position.
Figure 4:
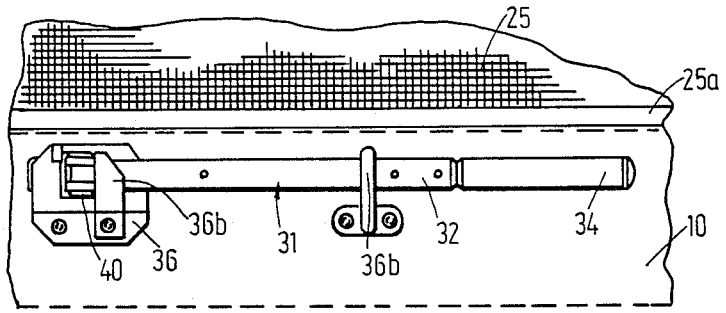
FIG. 4 is a front view of the link arm mechanism of FIG. 3.
Figure 5:
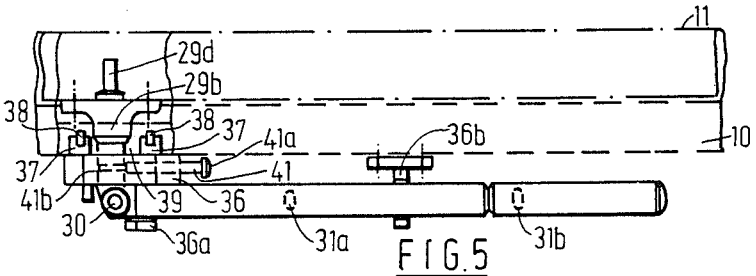
FIG. 5 is a top view of the link arm mechanism of FIG. 3.
Figure 6:
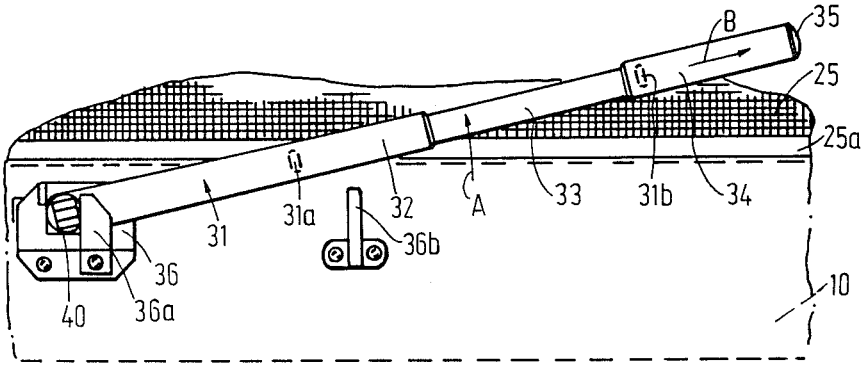
FIG. 6 is a front view of the link arm mechanism of FIG. 3 illustrated in a released, partly pivoted and telescopically extended position.
Figure 7:
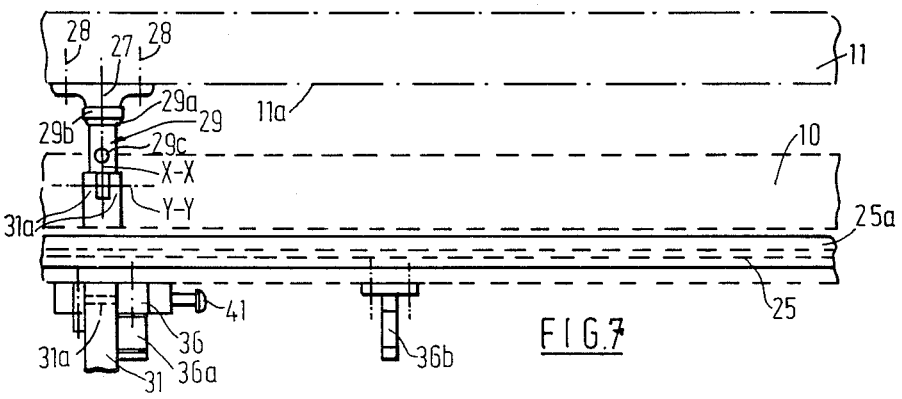
FIG. 7 is a schematical to view of the link arm mechanism of FIG. 3 illustrated in a position corresponding to a specific venting position of the window sash.

In FIGS. 3 to 5 the regulating arm 31 is arranged in a angular position sidewise of the axis x—x and horizontally along the window frame inner surface, i.e. along the surface facing inwards in the adjacent room and just outside the locking bar 41 at the locking member 36. The regulating arm 31 rests in a pair of support brackets 36*a* and 36*b* with the locking bar 41 in the active locking position as illustrated in FIG. 5. Upon retracting the locking bar 41 to an inactive position the regulating arm 31 is allowed to be activated and positioned in different active positions. As indicated by the arrow A in FIG. 6, the regulating arm 31 swings out of a horizontal inactive position towards an intermediate vertical position. In this position of FIG. 6 the arm member 33 with the associated head member 34 is extended axially as indicated by an arrow B into a telescopically extended position after having activated internal locking means in the arm 31 by means of the button 35. By pivoting of the regulating arm 31 an angle of 90° about the pivot axis x—x from the locking position as illustrated in FIG. 4 to an upright, vertical position along the main plane of the window sash, the regulating arm 31 is allowed to be tilted about the axis y—y an angle of 90° in a direction into the adjacent room. This allows the regulating arm 31 to be pushed axially through the guide opening 40 of the lock means 36 and thereby also push the window sash to an opened venting position as illustrated in FIGS. 2 and 7. Due to the uniform cross-section of the regulating arm 31 it is also possible—after having intermittently detached the screen filter from the window frame 10—to push the arm 31 further through and axially out of the guide opening 40 and the passage 39 in the window frame 10 in order to release the window sash and allow the window sash to be turned approximately 180° into a position with the normally outer window surface facing inwards to the adjacent room. This enables easy cleaning of the outer window surface from the adjacent room.

We claim:

1. A turnable window arrangement comprising a window frame; a sash; a pair of support arm mechanisms secured to said frame and said sash, each mechanism having a pair of pivot arms to permit pivoting of said sash; a pair of guide shoes mounted in opposite sides of said sash; a pair of grooves in opposite sides of said frame, each said groove slidably receiving a respective guide shoe of said sash to limit pivoting of said sash to a swing path of approximately 180°; said window frame being provided with a separately removable air screening filter secured to the frame in a position inside the swinging path of said sash, a link arm mechanism arranged to lock said sash in different positions between completely closed and opened venting positions, said link arm mechanism comprising a socket member connected to said sash and a link arm pivotally mounted at the outer end of a support arm protruding from said socket member to allow pivoting of said link arm about a first axis extending laterally of said support arm, said support arm being arranged to penetrate through a guiding in a lock member secured to said frame in a position circumferentially outside said screen filter to allow unprevented movement of said link arm at an inwards facing side of the frame, said link arm and said support arm being pivotable in said socket member about a second axis extending axially of said support arm to allow pivoting of the link arm from a locking position to an unlocked position, and vice versa, at said inwards facing side of the frame and also to allow a minor pivoting between said support arm and said link arm when moving said window sash into different venting positions, said link arm being provided with a number of arresting means extending laterally of said link arm for cooperation with an adjustable locking pin in said locking member.

2. A turnable window arrangement of claim 1, wherein said support arm in a longitudinally restricted area thereof is provided with a cylindrical portion to allow pivoting of said support arm and said link arm in said guiding in said lock member, whereas said link arm and said guiding have mutually matching polygonal cross-section.

3. A turnable window arrangement of claim 1, wherein said link arm is a telescope arm mechanism with an inner arm inserted in a pipe shaped outer arm and being lockable in longitudinally spaced positions therein.

4. A turnable window arrangement of claim 3, wherein said inner arm at the outer free end thereof is provided a manipulating head provided with operating means for locking of respectively releasing of cooperating locking means in said inner arm and said outer arm.

5. A turnable window arrangement of claim 1 wherein the whole length of said link arm including said manipulating head has a cross-section matching with, i.e. by preference corresponding with the cross-section of the guiding in said lock member.

6. A turnable window arrangement comprising a window frame having a locking groove;

a window sash having a first locking pin movable into said locking groove of said frame with said sash in a closed position in said frame;

a pair of support arm mechanisms secured to said frame and said sash, each mechanism having a pair of pivot arms to permit pivoting of said sash;

a pair of guide shoes mounted on opposite sides of said sash;

a pair of grooves in opposite sides of said frame, each said groove slidably receiving a respective guide shoe of said sash to limit pivoting of said sash in a swing path of approximately 180°;

an air screen filter removably mounted in said frame inside said swing path;

a link arm mechanism for locking said sash in a multiplicity of open positions between a closed position and a fully opened vented position, said mechanism including a socket member connected to said sash, a lock member mounted on said window frame in a position outside said screen filter and having a guide opening therein, a support arm pivotally mounted on a longitudinal axis in said socket member and passing through said frame and said guide opening in said lock member at one end and projecting into said sash on an opposite end to engage said locking pin, a regulating arm pivotally connected to said one end of said support arm on a side of said window frame opposite said sash for pivoting about a second axis perpendicular to said longitudinal axis between a first position parallel to said window frame and an unlocking position coaxial of said guide opening for sliding therethrough to pivot said sash relative to said window frame, said regulating arm being pivotable with said support arm about said longitudinal axis to move between said first position and a locking position parallel to said window frame, an adjustable locking pin in said lock member for selectively locking said support arm relative to said window frame with said regulating arm in said locking position to prevent movement of said sash from said frame and said support arm engaging said first locking pin to move said first locking pin into said groove of said window frame with said regulating arm in said locking position.

7. A turnable window arrangement as set forth in claim 6 wherein said regulating arm and said guide opening have mutually matching polygonal cross-sections for sliding therethrough.

8. A turnable window arrangement as set forth in claim 6 wherein said regulating arm is longitudinally adjustable.

9. A turnable window arrangement as set forth in claim 6 wherein said regulating arm has a plurality of stop means disposed longitudinally thereof for selective engagement of said adjustable locking pin in said lock member therein to secure said sash in an open position.

* * * * *

UNITED STATES PATENT AND TRADEMARK OFFICE

CERTIFICATE OF CORRECTION

PATENT NO. : 4,860,811

DATED : August 29, 1989

INVENTOR(S) : EGIL FLAKK

It is certified that error appears in the above-identified patent and that said Letters Patent is hereby corrected as shown below:

Column 2, line 40 "to" should be -top-

Signed and Sealed this

Twenty-eighth Day of August, 1990

*Attest:*

HARRY F. MANBECK, JR.

*Attesting Officer*

*Commissioner of Patents and Trademarks*